US006039292A

United States Patent [19]

Danzyger et al.

[11] Patent Number: 6,039,292

[45] Date of Patent: Mar. 21, 2000

[54] WRIST REST ASSEMBLY

[75] Inventors: Howard L. Danzyger, Aurora; Karenann Brow, Elgin; James Caruso, Evanston; Timothy Hibbard; Steven McPhilliamy, both of Chicago; Michael Thuma, Des Plaines, all of Ill.

[73] Assignee: Fellowes Manufacturing Co, Itasca, Ill.

[21] Appl. No.: 09/193,921

[22] Filed: Nov. 17, 1998

[51] Int. Cl.[7] ..... B43L 15/00

[52] U.S. Cl. ..... 248/118.5; D14/114

[58] Field of Search ..... 248/118, 118.1, 248/118.3, 118.5, 346.01, 346.03, 346.06, 347.07, 349.1, 918, 298.1, 285.1, 282.1; 400/715; D14/114; 108/137, 139, 140, 142

[56] References Cited

U.S. PATENT DOCUMENTS

| | | | |
|---|---|---|---|
| 254,388 | 2/1882 | Schultz | 108/140 |
| D. 356,785 | 3/1995 | Dickerson et al. | D14/114 |
| D. 357,010 | 4/1995 | Dickerson et al. | D14/114 |
| D. 375,300 | 11/1996 | Wu | D14/114 |
| D. 406,578 | 3/1999 | Fitzsimmons | D14/114 |
| 988,893 | 4/1911 | Packewitz . | |
| 1,618,374 | 2/1927 | Faust | 108/140 |
| 2,821,240 | 1/1958 | Morril, Jr. | 108/140 |
| 4,733,618 | 3/1988 | Sarro et al. | 108/140 |
| 4,822,103 | 4/1989 | Stenvall | 297/411 |
| 5,058,840 | 10/1991 | Moss et al. | 248/118.5 |
| 5,079,789 | 1/1992 | Jandrakovic | 5/81 R |
| 5,108,057 | 4/1992 | Dandy, III et al. | 248/118 |
| 5,131,614 | 7/1992 | Garcia et al. | 248/118 |
| 5,161,760 | 11/1992 | Terbrack | 248/118 |
| 5,165,630 | 11/1992 | Connor | 248/118.1 |
| 5,201,485 | 4/1993 | Moss et al. | 248/118 |
| 5,203,845 | 4/1993 | Moore | 248/118 |
| 5,246,191 | 9/1993 | Moss | 248/118.3 |
| 5,265,835 | 11/1993 | Nash | 248/118 |
| 5,386,957 | 2/1995 | Miller | 248/118.5 |
| 5,398,896 | 3/1995 | Terbrack | 248/118.5 |
| 5,433,407 | 7/1995 | Rice | 248/118.1 |
| 5,472,161 | 12/1995 | Krukovsky | 248/118.5 |
| 5,478,034 | 12/1995 | Cunningham et al. | 248/118.5 |
| 5,490,647 | 2/1996 | Rice | 248/118.1 |
| 5,522,572 | 6/1996 | Copeland et al. | 248/118 |
| 5,597,208 | 1/1997 | Bonutti | 297/411.35 |
| 5,648,798 | 7/1997 | Hamling | 345/163 |
| 5,655,814 | 8/1997 | Gibbs | 297/411.38 |
| 5,657,956 | 8/1997 | Smith et al. | 248/349.1 |
| 5,727,759 | 3/1998 | Christensen | 248/118 |
| 5,743,499 | 4/1998 | Wang | 248/118 |
| 5,762,302 | 6/1998 | Myers | 248/118.5 |
| 5,833,180 | 11/1998 | Baranowski | 248/118 |
| 5,881,976 | 3/1999 | Gutowski | 248/118.5 |

OTHER PUBLICATIONS

William B. Walters, "Introducing the latest innovation in ergonomic wrist rest design. The Wrist Disk", Litman Law Offices, Ltd., Arlington, VA.

William B. Walters, "Introducing the WristDisk", Litman Law Offices, Ltd., Arlington, VA.

*Primary Examiner*—Anita M. King
*Assistant Examiner*—Michael Nornberg
*Attorney, Agent, or Firm*—Brinks Hofer Gilson & Lione

[57] ABSTRACT

A wrist rest assembly has a base with a first end, a second end, and a pivot post mounted on the base near the first end. A tray has an elongated slot that receives the pivot post to allow movement of the tray about the pivot post.

11 Claims, 8 Drawing Sheets

WRIST REST ASSEMBLY

BACKGROUND OF THE INVENTION

The present invention relates to a wrist rest assembly for a horizontal work surface. In particular, the present invention relates to a support for a user's wrist which is movably mounted on a base.

It is well known that the use of desktop computer equipment for extended periods of time may cause posture and stress related injuries. Repetitive motion stress injuries to the wrist, such as carpal tunnel syndrome, which occur due to operation of computer keyboards and pointing devices, have become increasingly commonplace. Carpal tunnel syndrome generally results from stress to the wrist caused by a combination of wrist posture and chronic repetitive wrist and finger motions. When manipulating a device such as a computer keyboard or computer mouse, a user's wrist is held for extended periods in a bent position above and away from the desk or table. Repetitive motion stress injuries such as carpal tunnel syndrome occur as a result of repetitive or maintained contraction of the connective tissue structures and musculature around the wrist. Placing a support underneath the wrist and directly behind the device elevates the user's wrist into a more neutral position, on a level with the user's hand. Placing the wrist in a neutral position, straight rather than bent, eases the strain placed on the wrist extensors and their tendons, as well as the tensile stresses placed on the anterior wrist connective tissues leading to hypertrophy of the ligament which causes carpal tunnel syndrome. In addition, supporting the wrist through its movements on the horizontal work surface is especially beneficial in reducing the wear and tear on muscles and connective tissue that leads to repetitive stress injuries.

Efforts to decrease the stresses placed on the wrist have traditionally focused on therapeutic procedures performed on the user after the injury has occurred, including splinting and even surgery. In recent years, as computer use has skyrocketed and repetitive-stress wrist injuries become more commonplace, various preventive and palliative supports for the upper extremities of the operator have been developed.

Many prior art wrist rests help to relieve posture- and stress-related injuries of keyboard users by supporting the wrist in a position relative to the hand and arm so that the degree of bending at the wrist is decreased, thus decreasing the stress caused by repetitive motion. One such wrist support device is U.S. Pat. No. 5,131,614 to Garcia et al. The wrist support suggested by Garcia et al. includes a longitudinal pad to extend in front of a keyboard and outwardly from one edge thereof, such that the longitudinal pad may also be used in conjunction with a computer mouse. The use of stationary devices, such as that contemplated by Garcia et al., ease only a portion of the stress placed on the wrists of computer keyboard and mouse users. Prior art wrist rests that perform a stationary support function only are limited in that they do not support the user's wrist as the wrist moves about atop the horizontal work surface.

Other wrist support assemblies known in the prior art provide for a user's wrist moving atop a work surface. For example, U.S. Pat. No. 5,478,034 to Cunningham et al. teaches a wrist support device that includes a base portion which may be placed under a keyboard and which supports an elongated, cylindrical slide rod. Cushioned wrist support rollers slide along the rod and rotate about the axis of the rod. Such devices with movable wrist supports have several distinct disadvantages. They are often specifically designed for use with a computer keyboard and are too large and cumbersome for use with a smaller object such as a computer mouse. Many devices have several different metal parts and may require complex adjustment during operation. Furthermore, the range of movement of the wrist support on prior art wrist supports is often specialized for wrist and hand movements across a computer keyboard. This limited range of movement is often not compatible with other devices such as trackballs, pens, and computer mice, which provide a fluid, free form motion within a space.

Other prior art devices provide a free form range of motion within a space. Such devices are often directed to support of the operator's forearms, and are primarily intended to support the weight of the user's arm, thus allowing the upper arm and shoulder muscles to release their sustained contraction. For example, U.S. Pat. No. 5,201,485 to Moss et al. teaches an arm rest assembly which includes a forearm support cradle mounted on a slide assembly which is in turn mounted on a thin planar base. The slide assembly allows linear movement of the arm toward and away from the assembly and pivots in the plane of the base, thus permitting free movement of the forearm support within a restricted space. However, in using a device that supports only the user's forearm, the user's wrist is left completely unsupported during movements that primarily engage the wrist. Accordingly, forearm supports are of limited benefit when the operator must engage the wrist in rotating, pushing and pulling movements such as those employed in the manipulation of a small object such as a computer mouse on a work surface.

Another type of prior art wrist and forearm supports is freestanding and not otherwise mounted to a base or other support. One such device is set forth in U.S. Pat. No. 5,472,161 to Krukovsky. The user's wrist rests atop the upper surface where it is secured by a wrist band, and the bottom surface comprises a plurality of rolling elements to facilitate ease of movement across a horizontal surface. U.S. Pat. No. 5,165,630 to Connor teaches a movable wrist support which may be fixedly connected to a computer mouse. The apparatus therein includes a sized pad with a bottom surface made of a friction free material and a top surface that cushions and supports the wrist. Wrist supports such as those taught by Krukovsky and Connor provide some freedom of movement for manipulating a device such as a computer mouse. However, these supports do not include a planar base. Hence, they may be inconvenient to use with a computer mouse pad or other special surface that rests atop the user's desk or table work surface, as the gliding motion of the support is not fully integrated with the work surface. Manueverability of the object manipulated by the wrist is therefore limited. Furthermore, the gliding motion of these prior art wrist supports is dependent on the work surface upon which the wrist supports glide. The quality of the gliding motion is therefore unpredictable and, if not monitored, may lead to deterioration of the gliding mechanism.

Accordingly, it is an object of the present invention to provide a wrist supporting device that has relatively unrestricted mobility across a bounded work surface and that requires only minimal effort for rapid movement within the boundaries of the work surface.

A further object of the invention is to provide a wrist supporting device where the unrestricted movement of the support is fully integrated with an attached work surface so that the movement of the support will not exceed the boundaries of the work surface.

A still further object of the present invention is to provide an inexpensive and durable wrist supporting device which is of simple construction, adaptable to different uses, and requires very little maintenance.

It is also an object of the present invention to provide a movable wrist supporting device that is intuitive to use with a computer mouse and that is suited to the gliding movement of a computer mouse across a horizontal work surface.

BRIEF SUMMARY OF THE INVENTION

The present invention provides a wrist support assembly comprising a base with a first end and a second end, and a pivot post attached to the base near the first end. A tray has an elongated slot that receives the pivot post, to allow movement of the tray about the post.

The user positions his or her wrist on the pad as needed to manipulate a hand held object on a work surface located near the second end of the base. To move the object, the user places his or her wrist on the tray, and moves the tray using the arm and shoulder. An elongated slot is positioned underneath the wrist support pad and moves about the pivot post mounted on the tray. The tray moves linearly as the elongated slot glides through the pivot post attached on the base. The smooth, cooperative motion of the sliding and pivoting of the elongated slot about the pivot post allows a wide range of movement with simple movement by the user.

DETAILED DESCRIPTION OF THE PREFERRED EMBODIMENTS

Figure 1:
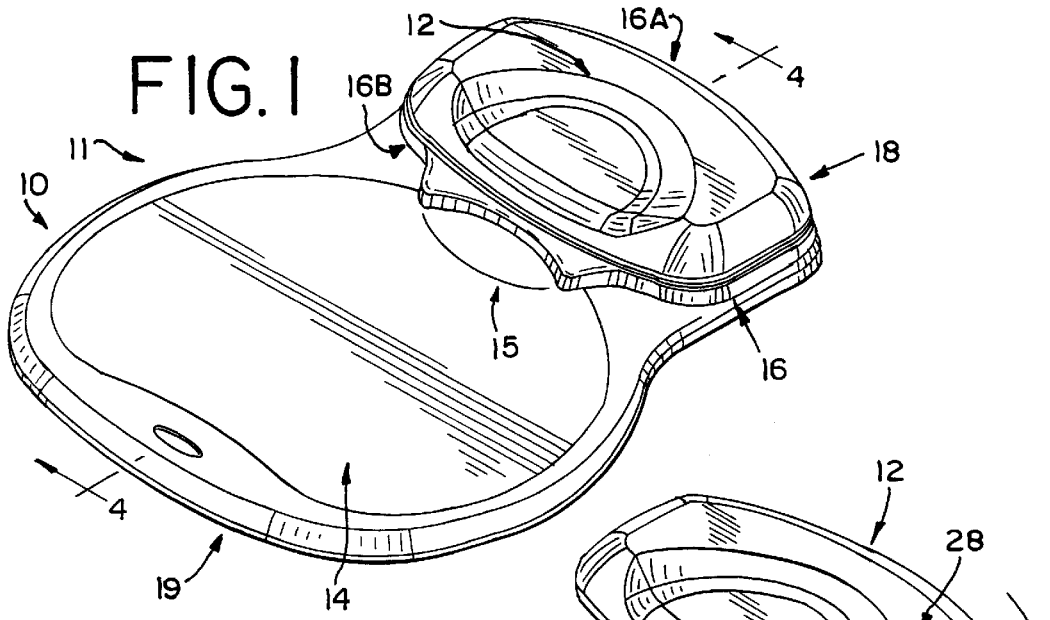
FIG. 1 is a perspective view of one embodiment of the wrist support assembly of the present invention.
Figure 2:
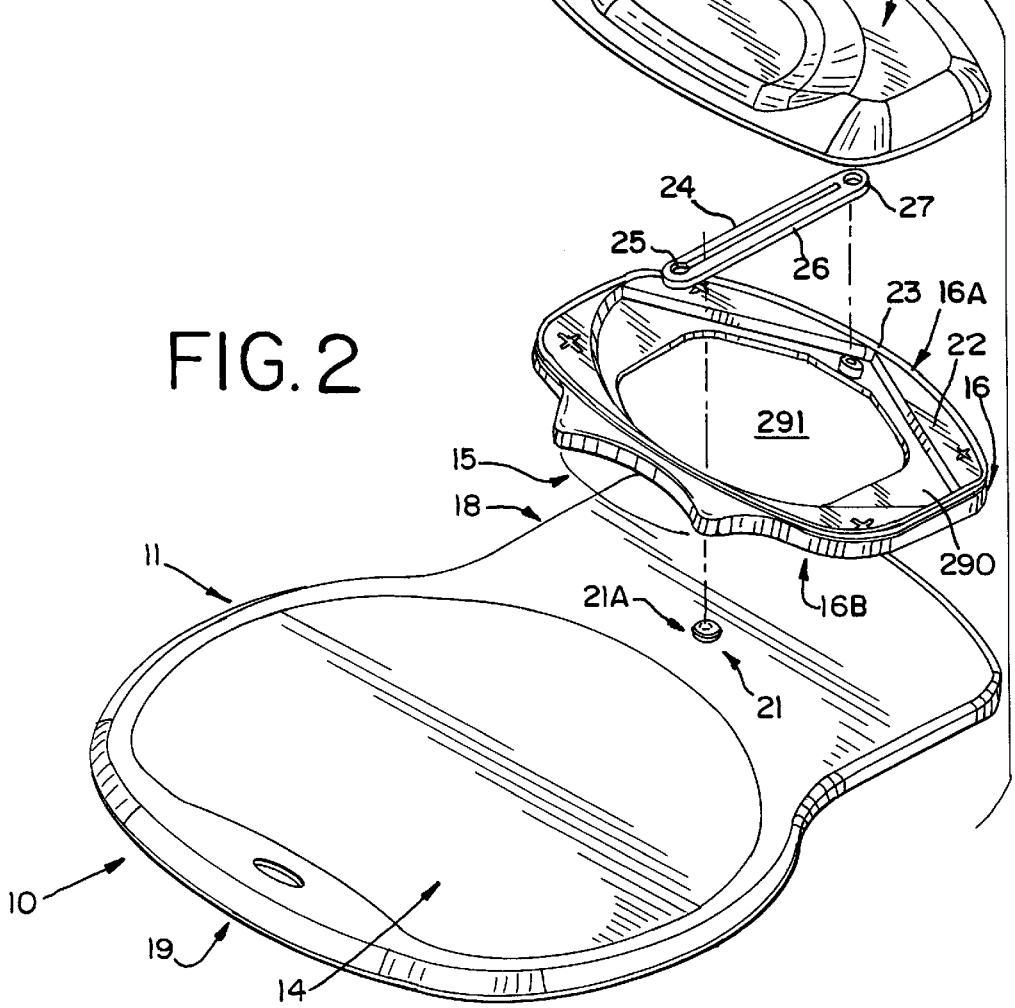
FIG. 2 is an exploded perspective view of the wrist support assembly of FIG. 1.

Referring now to FIG. 1, there is shown a wrist rest assembly designated generally by the numeral 10. The assembly 10 includes a base 11, which comprises a first end 18 and a second end 19. As shown in FIG. 2, a pivot post 21 is mounted on the base near the first end 18. A tray 16 comprises a first surface 22 and a second surface 32 such that the second surface 32 is in contact with the first end 18 of the base. Preferably, the tray 16 is freely movable on the first end 18 of the base. A pivot pin 23 is mounted on the first surface 22 of the tray 16. A slide 24 has an elongated slot 26 for receiving the pivot post 21 and an aperture 27 for receiving the pivot pin 23. Preferably, a pad 12 is disposed on the first surface 22 of the tray 16. The pad 12 has an upper surface 28 for supporting a user's wrist.

The base 11 is planar and of relatively thin profile. It can be constructed from molded plastic or produced from some other suitably durable, lightweight material that provides a thin profile. The pivot post 21 is mounted near the second 19 end of the base. In the center of the pivot post 21 there may be a hole for receiving a pin 25 to lock the pivot post 21 into the elongated slot 26 on the slide 24. All or a portion of the upper surface of the base 11 can be of a smooth texture to reduce friction and facilitate the gliding motion of the tray 16. Preferably, at least the portion of the upper surface of the base in contact with the tray 16 has a smooth texture. In addition, a work surface 14 may be disposed between the first 18 and second 19 end of the base. The work surface 14 provides a surface upon which an input device, for example a computer mouse or trackball, and more particularly the tracking mechanism of the input device can be manipulated. Desirably, the work surface comprises a material that provides sufficient resistance to movement of the input device yet allows sufficient freedom of movement so that minimal movements of the input device are suitable for controlling a computer.

Desirably, the work surface includes a shallow recess 31 in which a mouse pad can be located. More preferably, the recess 31 should be of sufficient depth so that the top surface of the mouse pad will be flush with the upper surface of the base. The mouse pad is comprised of materials well known in the art, that enable precise tracking of computer mice, trackballs, and the like. For example, the mouse pad can be made from neoprene, foam rubber covered with fabric, and those materials described in U.S. Pat. No. 5,508,084, the relevant portions of which are incorporated herein by reference.

Figure 3:
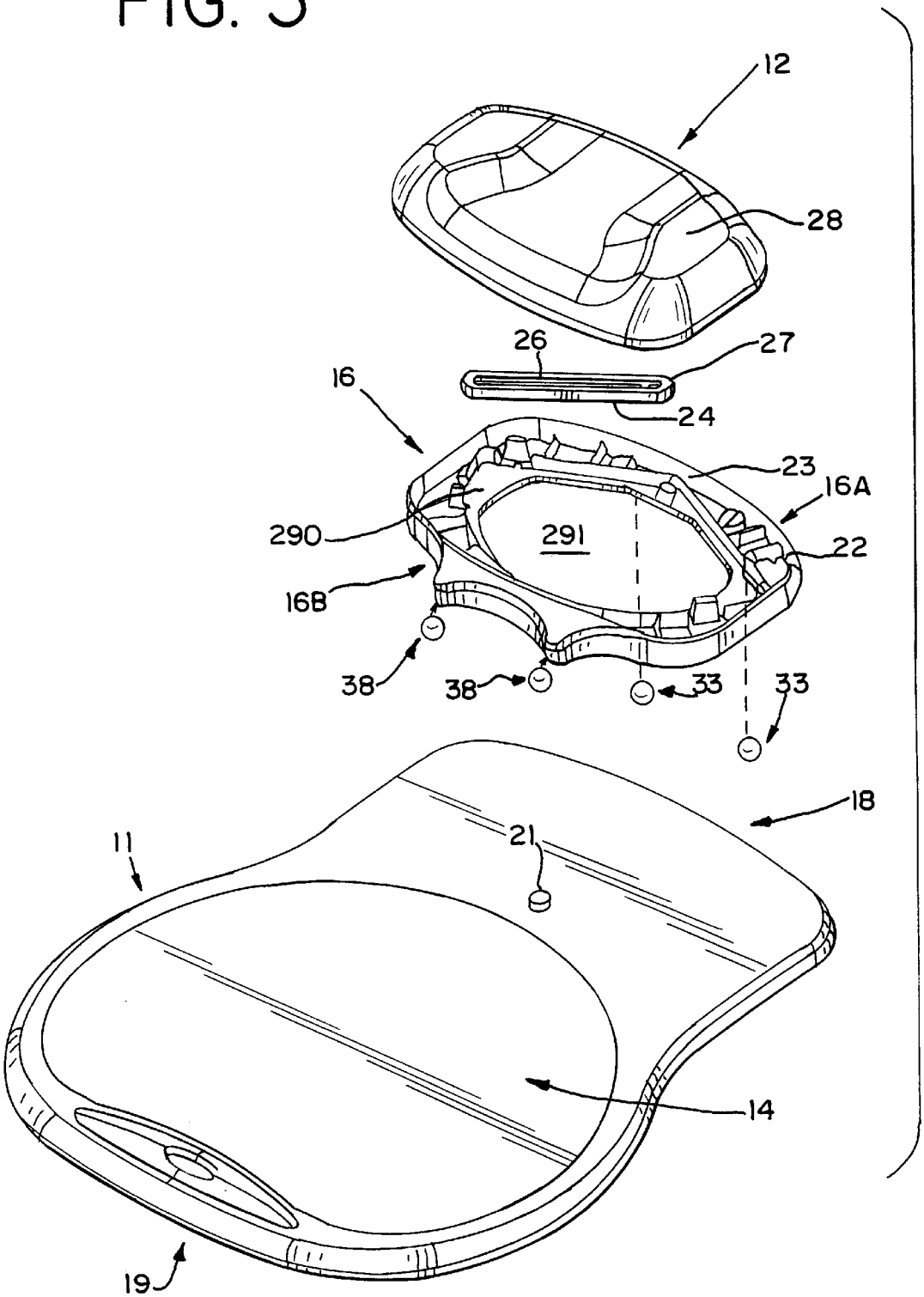
FIG. 3 is an exploded perspective view of the wrist support assembly of FIG. 1.
Figure 4:
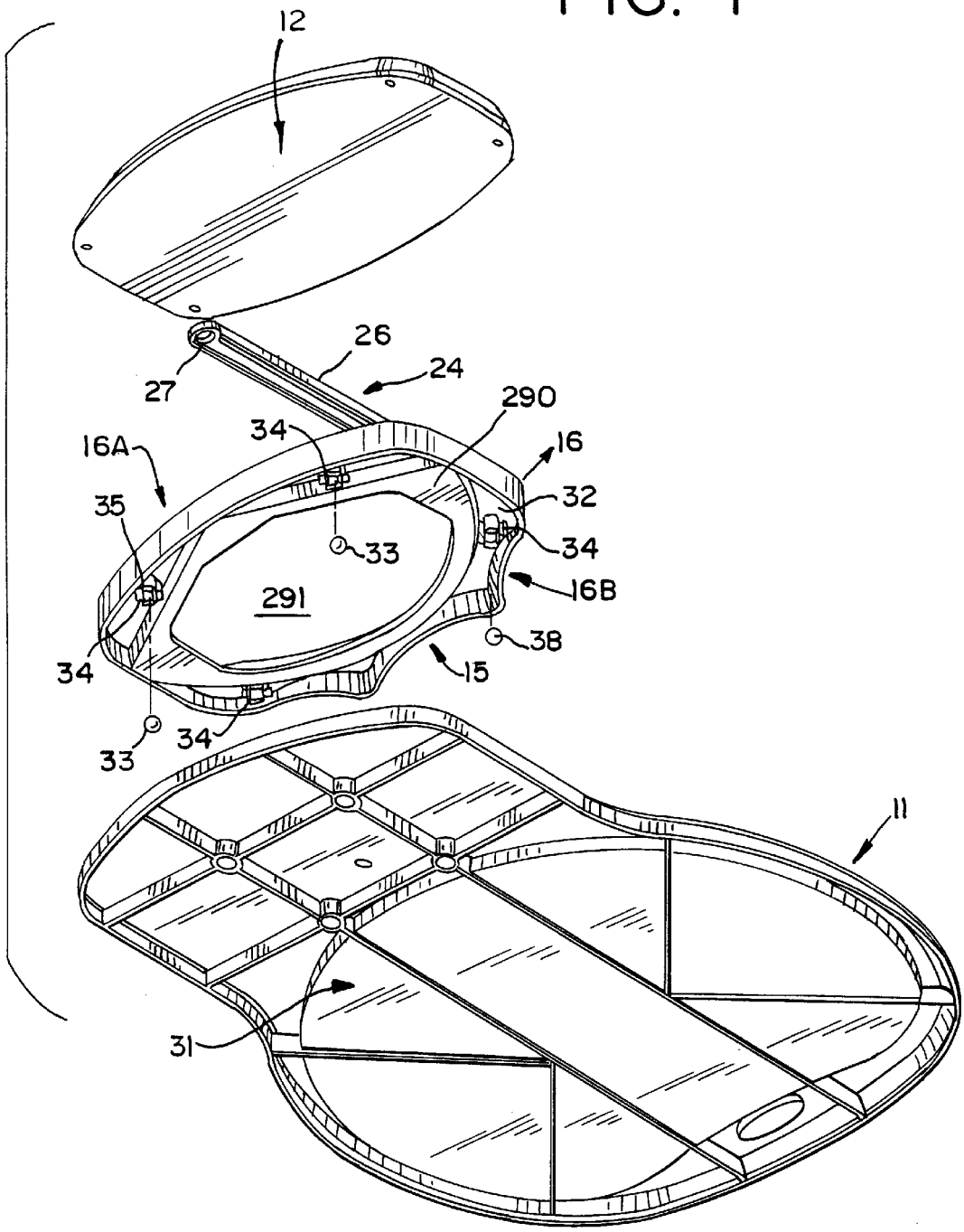
FIG. 4 is a bottom exploded perspective view of the wrist support assembly of FIG. 1.

The tray 16 has a first surface 22 shown in FIG. 3 and a second surface 32 shown in FIG. 4. The first surface 22 of the tray 16 is the surface on which the wrist support pad 12 is disposed. In addition, a pivot pin 23 is mounted on the first surface 22 of the tray 16. The second surface 32 of the tray 16 is the surface which is closest to the upper surface of the base 11. In the preferred embodiment of the present invention, the first surface of the tray 22 comprises a recess 290 to hold the slide 24, as shown in FIG. 3. The pivot pin 23 is mounted in the recess 290, and the bottom of the recess 290 has a large opening 291 to receive the pivot post 21. The opening 291 facilitates movement of the tray 16 about the pivot post 21. In addition, the tray 16 has a first side 16A and a second side 16B. The first side 16A is adjacent to the first end 18 of the base 11. The second side 16B is positioned toward the second end 19 of the base 11 near the work surface 14.

FIGS. 2 and 3 shows two embodiments of the present invention where the slide 24 comprises an elongated slot 26 having an end for receiving the pivot post at one end, and an aperture 27 at a second end for receiving the pivot pin. The slide 24 rests within the recess 290 of the tray 16, and pivots about the pivot pin 23 mounted in the recess 290. The slide 24 can also move linearly as the elongated slot 26 glides through the pivot post 21 mounted on the base 11. Note, however, that this linear movement is bounded by the size of the elongated slot 26. The pivot post 21 may have an enlarged upper portion 21A opposite the base 11. The pivot post 21 can be locked into the elongated slot 26 by inserting the enlarged head 21A of the pivot post 21 through one end 25 of the elongated slot 26 that has been enlarged to fit the pivot post 21. It is contemplated that the ends of the elongated slot 26 do not coincide with the opening 291 of the tray 16. Thus, the pivot post 21 will be locked into the elongated slot 26. Since the slide 24 is connected to the base 11 through the bottom of the tray 16, the opening 291 defines the space through which the tray 16 moves on the base 11.

Desirably, the wrist support pad 12 is disposed on the upper surface of the tray 16, as shown in FIG. 1, and has an upper surface for supporting a user's wrist. It is contemplated that the upper surface of the pad will have a contour shape, as shown in FIG. 1 to conform to a user's wrist and downward facing palm. The wrist support pad 12 may be made of a gel and may be covered with low friction fabric such as polyurethane or LYCRA. The gel may include water-based gels, stable elastomeric block polymer gels, urethane, and any other suitable gels. Examples of suitable elastomeric block polymer gels can be found in U.S. Pat. Nos. 3,676,388, 4,369,284, 5,633,286 and 5,713,544, and the relevant disclosures of each are incorporated herein by reference. Examples of polyurethane gels include those in U.S. Pat. Nos. 4,346,205, 4,476,258, 4,722,946 and 4,980, 386, and the relevant disclosures of each are incorporated herein by reference. Alternatively, the wrist support pad 12 may comprise rubber, foam rubber, or any of a number of other materials well known in the art. Of course, these pads may also be covered with a low friction fabric as is known in the art. Alternatively, the top surface of the tray may be formed or contoured into a shape suitable for substantially conforming to a user's wrist.

The bottom 36 of the wrist pad 12 may be comprised of a more rigid material such as urethane, neoprene rubber, molded plastic, wood, metal, and the like, which can then be attached to the tray 16 using, for example, VELCRO patches, or hooks affixed to the first surface of the tray which attach to slots on the wrist pad bottom 36. The wrist pad bottom 36 provides shape to the wrist support pad 12, as well as support to the wrist. The rigid wrist pad bottom also acts as a barrier between the softer wrist support and the sliding mechanism underneath.

Figure 5:
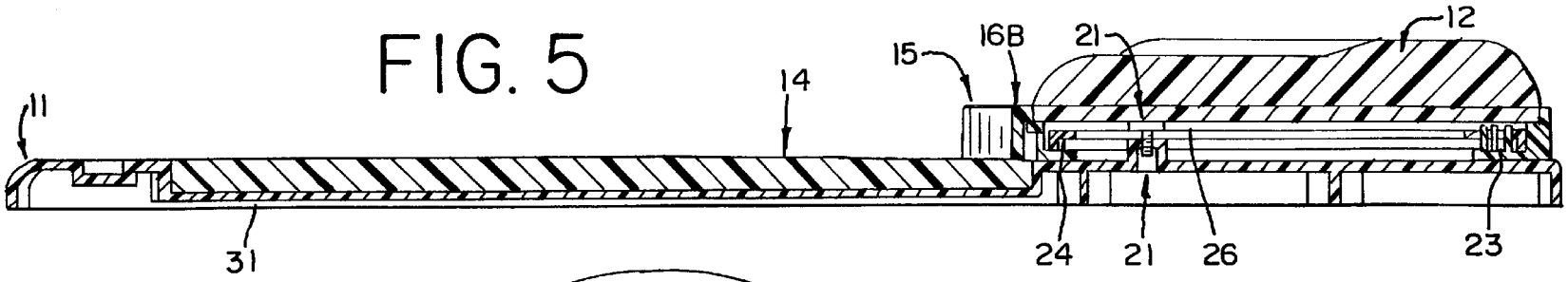
FIG. 5 is a cross sectional view of the wrist support assembly of FIG. 1, taken along section line 4—4.

FIG. 5 shows a cross section of the wrist support assembly of the present invention, in which the thin profile of the base 11 is shown. The upper surface of the work surface 14, which can be comprised of a material different than the material comprising the base 11, is flush with the upper surface of the base 11. The entire upper surface of the base 11, other than the pivot post 21, should be one uniform level, so that the tray 16 may glide atop the work surface 14 and the upper surface of the base 11.

As shown in FIG. 5, the slide 24 is positioned under the wrist support pad 12 and in the tray 16, and pivots about the pivot pin 23. Because the work surface 14 extends to the front and side of the tray 16, the pivot range of the slide 24 about the axis of the pivot pin 23 is contemplated as an arc. Additional maneuverability is provided by the pivot post 21 on the base 11. The elongated slot 26 of the slide 24 slides through the pivot post 21. Thus, the full range of movement of the wrist support is contemplated as the area of a segment of a circle. The radius of the circle would be the length of the elongated slot, but the range of movement may be limited by the size of the opening 291 which bounds the range in which the slide moves through the pivot post 21.

Figure 6:
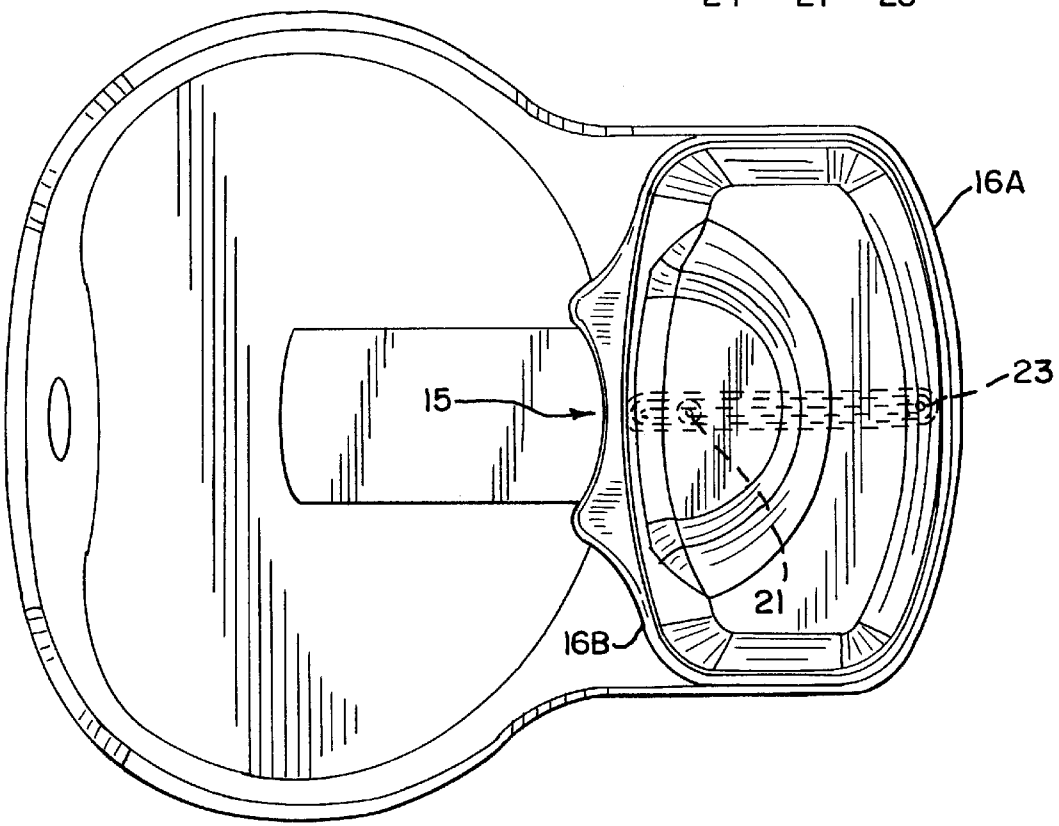
FIG. 6 is a top view of the wrist support assembly of FIG. 1, showing the wrist support in a rearward position with the relative position of the elongated slot, pivot post, and pivot pin shown in dotted lines.
Figure 7:
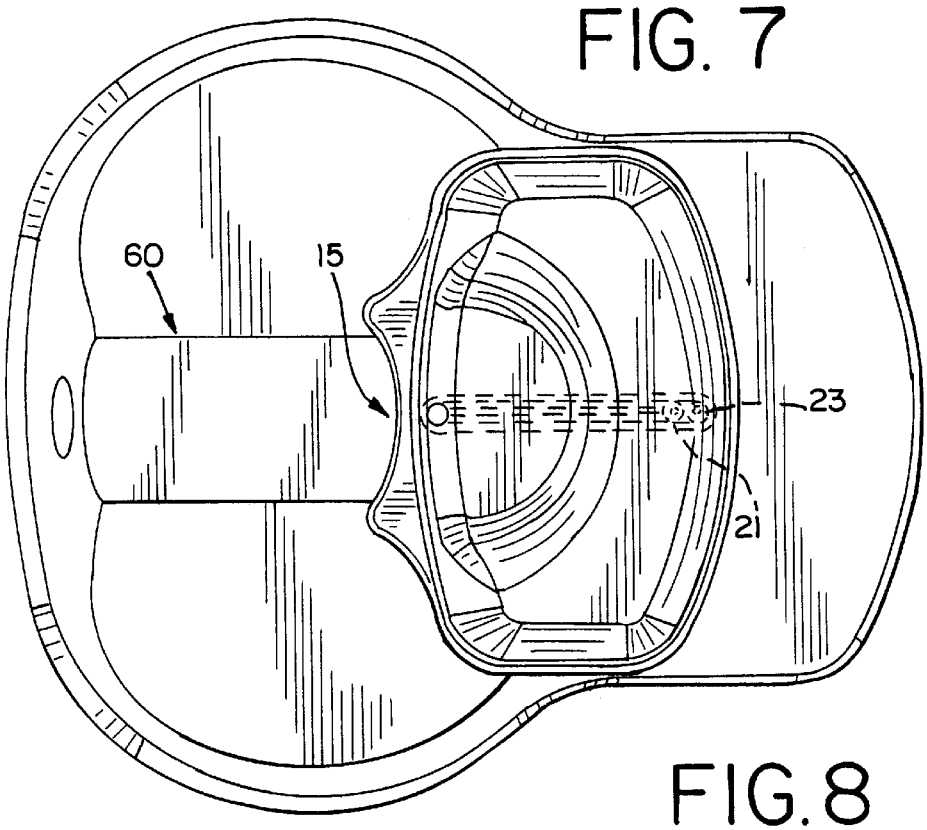
FIG. 7 is a top view of the wrist support assembly of FIG. 1, showing the wrist support in a more forward position with the relative positions of the elongated slot, pivot post, and pivot pin shown in dotted lines.
Figure 8:
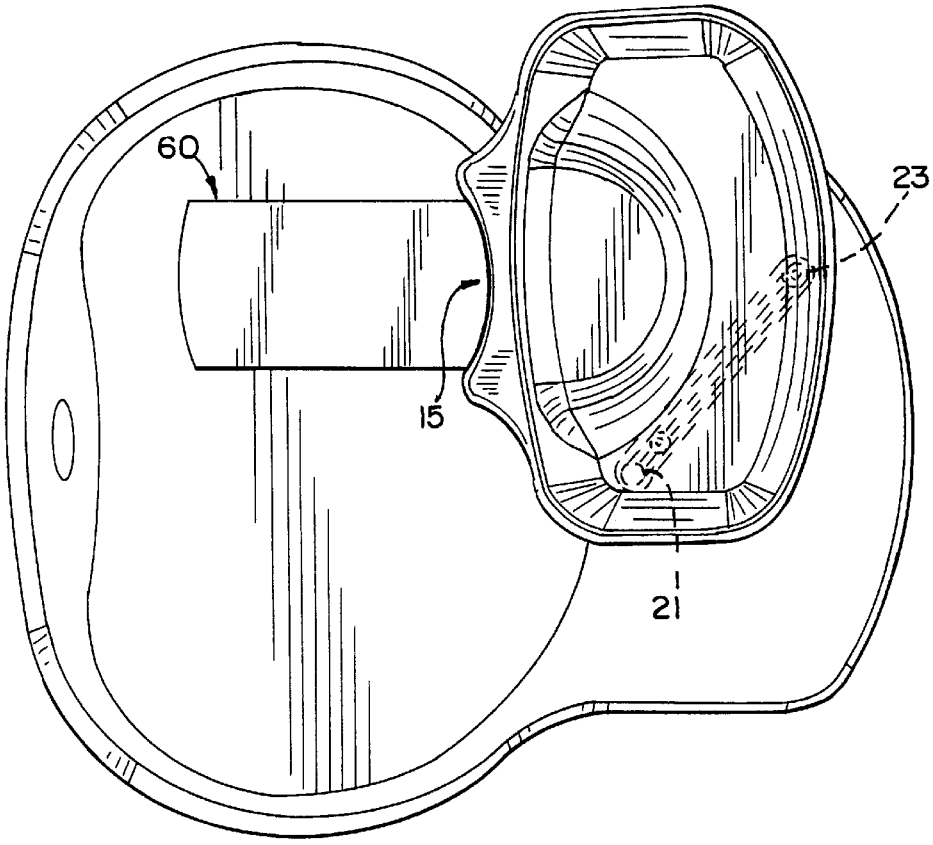
FIG. 8 is a top view of the wrist support assembly of FIG. 1, showing the wrist support in a side position with the relative positions of the elongated slot, pivot post, and pivot pin shown in dotted lines.

FIGS. 6, 7, and 8 show the wrist support in various positions. In FIG. 6, the wrist support is in a first position, nearly fully extended toward the rear, away from the horizontal work surface 14. This is seen by the dotted lines indicating the position of the pivot post 21, which is at the opposite end of the elongated slot from the pivot pin 23. The slide is also in the middle of its arc of rotation. In FIG. 7, the slide has remained in the middle of its arc of rotation, but now the wrist support is extended forward over the work surface 14. The pivot pin 23 is now immediately adjacent to the pivot post 21. The elongated slot has changed its position from FIG. 6 by moving through its entire length. In FIG. 8, the pivot post 21 and the pivot pin 23 are in the same position relative to each other as in FIG. 6, with the support pad in a rearward position, but the wrist support has now moved to the right.

The smooth, cooperative motion of the rotation of the pivot pin 23 and the sliding and pivoting of the pivot post 21 allows a wide range of movement with simple movement by the user. The user positions his or her wrist on the wrist rest as needed to manipulate the computer mouse or other hand held object. To move the computer mouse, the user holds the wrist stationary and moves the arm and shoulder connected to the wrist in order to move the mouse. The smooth feel of the sliding and rotation of the pivot post 21 and the pivot pin 23 is complemented by the gliding of the second surface of the tray 16 atop the upper surface of the base. The gliding motion can be enhanced by the use of gliding members.

Figure 9:
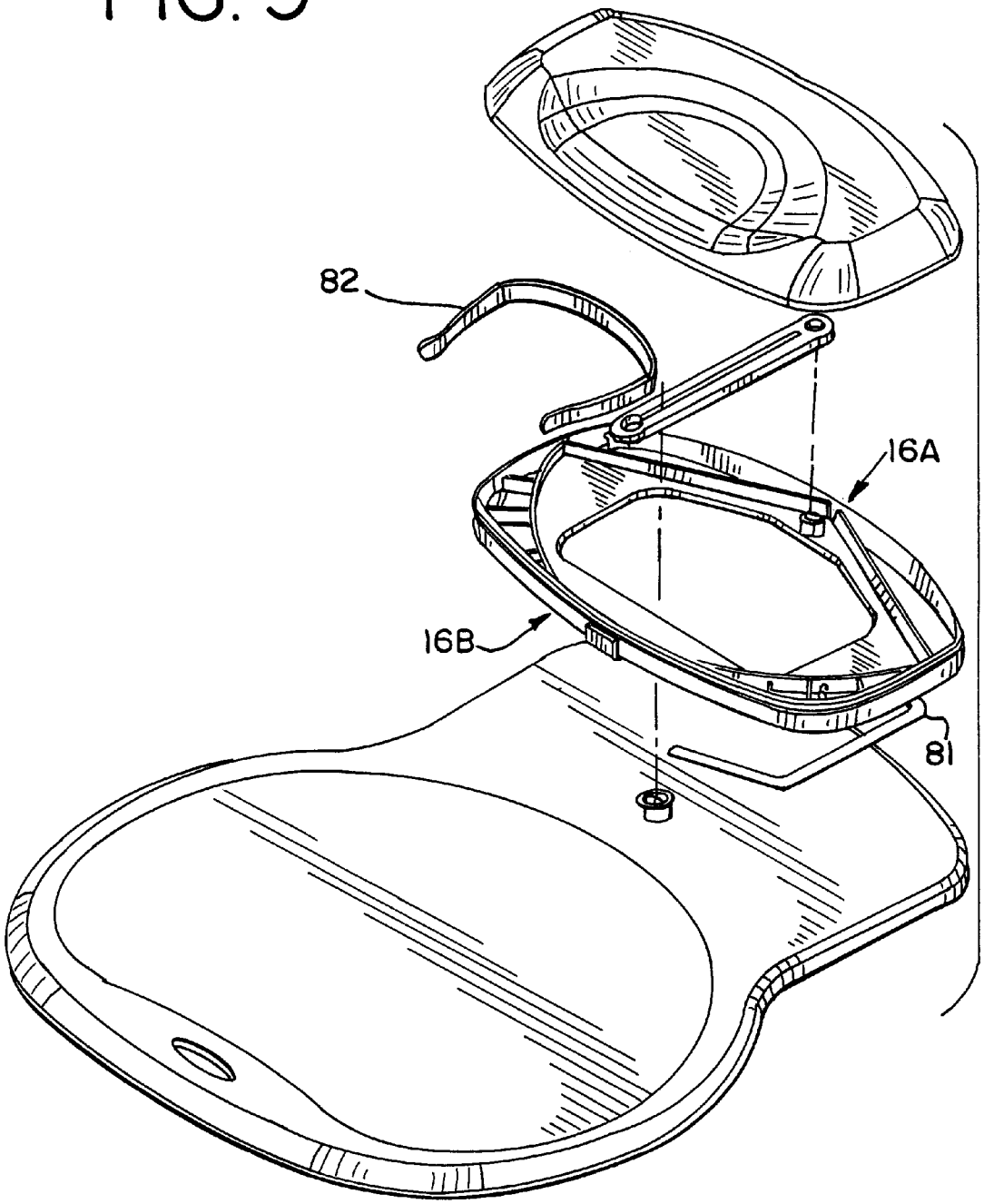
FIG. 9 is an exploded perspective view of an alternative embodiment of the wrist support assembly of the present invention.
Figure 10:
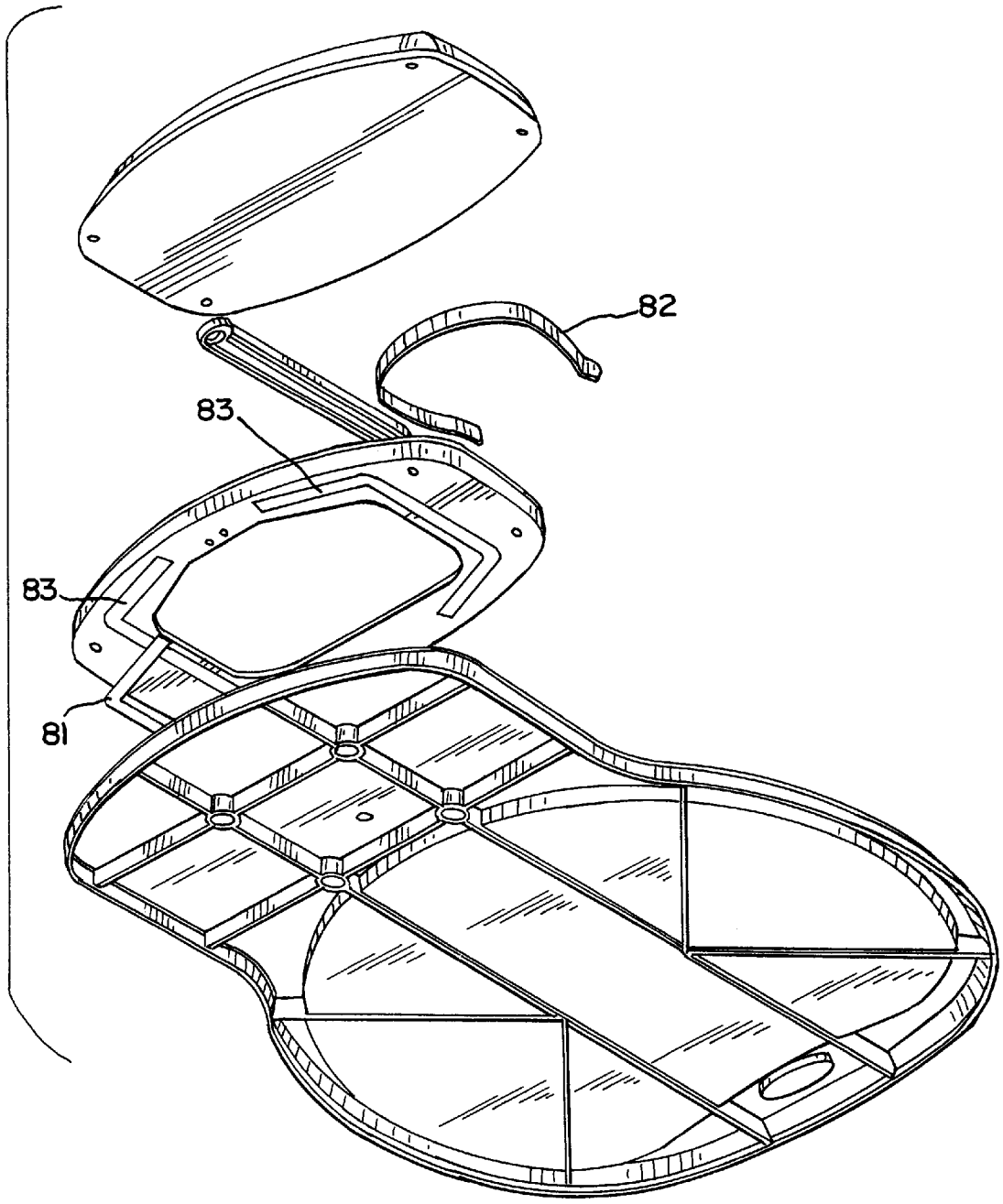
FIG. 10 is a bottom exploded perspective view of the wrist support assembly of FIG. 9.

Desirably, the tray is provided with at least one gliding member, e.g. a ball bearing 33 or a disk 38 made of low friction material to reduce the friction between the underside of the tray and the top surface of the base. In a preferred embodiment of the present invention, a plurality of bosses 34 are provided on the second surface 32 of the tray 16 near the second side 16A of the tray 16, as shown in FIG. 4. Each boss 34 adjacent to the second side 16A of the tray receives a ball bearing 33, which freely rotates within the boss 34. Preferably, a portion of the ball bearing 33 will protrude from the lip 35 of the boss. The protruding ball bearing makes contact with the surface of the base 11 to provide a gliding motion for the tray 16 as it moves on the base. The ball bearings may be used in combination with disks 38 made of low friction material that may be attached to bosses 34 positioned on the underside of the tray 16 near the first side 16A. In an alternative embodiment, shown in FIGS. 9 and 10, gliding strips 81 comprised of law friction material used exclusively as the gliding member. The gliding strips 81 make contact with the upper surface of the base 11 to facilitate the gliding motion of the wrist support. The footprints 83 in FIG. 10 show one possible positioning of the gliding strips 81 on the underside of the tray, although clearly the strips may be placed in an infinite variety of ways or may be formed in an infinite variety of shapes. In both the preferred embodiment and the alternative embodiments the low friction material may comprise polytetrafluoroethylene (TEFLON), a polyethylene plastic, or other materials well known in the art. In another embodiment, the gliding members comprise a plurality of ball bearings 33, each mounted in boss 34.

Figure 11:
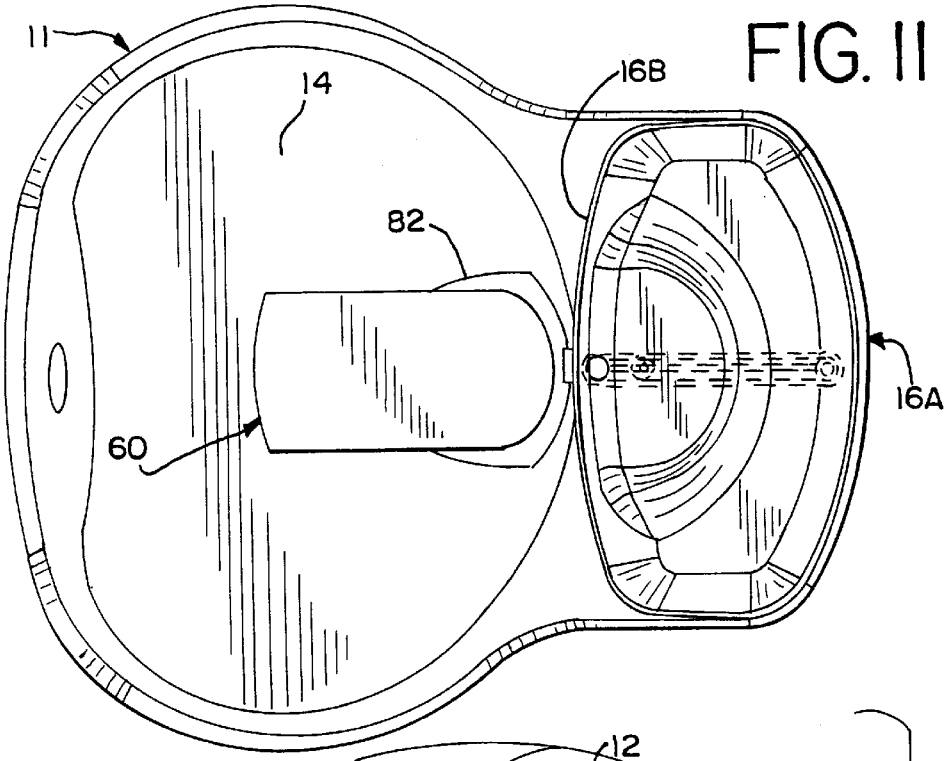
FIG. 11 is a top view of the alternative embodiment of FIG. 9, showing the position of a computer mouse held in the clip.

The tray 16 may also comprise a retainer 15 on the second side 16B of the tray 16. The retainer 15 is used to position and help retain the input device or computer mouse in close proximity to the tray. In one embodiment, the retainer 15 will be a shallow curve of sufficient width to cradle the palm end of a computer mouse or other hand held object 60, as shown in FIGS. 6, 7, and 8. In an alternative embodiment of the present invention, shown in FIGS. 9 and 10 the retainer comprises a clip 82 that may be attached to the second side 16B of the tray 16. The second side 16B attaches the curved portion of the U-shaped clip 82 which is sized to hold the palm end of a computer mouse or hand held object 60, as shown in FIG. 11.

Of course, the gliding motion may be accomplished by means other than those discussed above. For example, TEFLON buttons may be used in place of TEFLON strips to provide a gliding surface with minimum friction. Or, in place of the individually mounted ball bearings, a number of ball bearings can be rotatably mounted together in one housing, possibly in the shape of a strip or a ring, on the lower surface of the tray.

Figure 12:
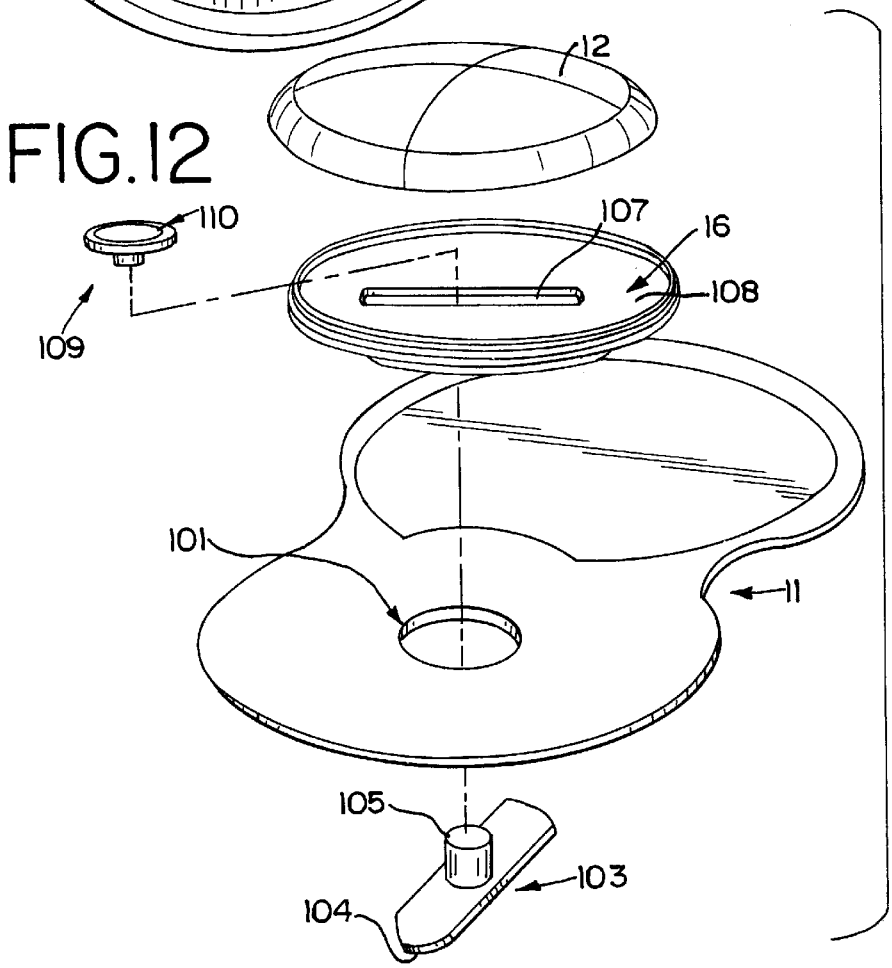
FIG. 12 is an exploded perspective view of an alternative embodiment of the wrist rest assembly of the present invention.

Another alternative embodiment of the present invention is shown in FIG. 12. In this embodiment, it is contemplated that the base will have a circular opening 101 disposed near the first end of the base 11. A connector 103 is positioned underneath the base 11. Preferably, the connector is T shaped and has a connector base 104 and a post 105. The circular opening 101 in the base 11 receives the post 105 of the connector. It is contemplated that the circular opening 101 is larger in diameter than the connector post 105. As shown in FIG. 12, the connector post is freely movable within the circular opening 101 in the plane of the base 11. The tray 16 is positioned above the base 11 and has a first surface 108 and an elongated slot 107, which also receives the connector post 105. The connector post 105 may receive a connector pin 109 through the elongated slot 107 and the circular opening 101. The connector pin 109 has a head 110 that is larger in diameter than the width of the elongated slot 107 and may attach to the post via a snap-on mechanism or other mechanism well known in the art.

The wrist rest assembly of the present invention is adaptable for many uses other than manipulation of a computer mouse. It should be appreciated that the foregoing structure and mechanism can be easily adapted for use with other computer equipment such as digitizer pens, digitizer pucks, and trackballs. The wrist rest assembly of the present invention may also be adapted for use with a keyboard. The wrist rest assembly may even be adapted for low technology tasks such as drawing or writing, that require the use of hand and arm movements on a relatively horizontal work surface. Furthermore, the wrist rest assembly of the present invention is of a modular design, so that several of these functions may easily be combined into a single product. For example, the work surface may be constructed as a removable pad, and may be changed as needed. Similarly, the wrist support pad can be removably attached to the tray, for example, by using VELCRO or a hook and slot mechanism as described above. A removable wrist support pad addresses possible hygienic or comfort concerns of users who may prefer their personal wrist support pads.

Those skilled in the art to which the invention pertains may make modifications and other embodiments employing the principles of this invention without departing from its spirit or essential characteristics, particularly upon considering the foregoing teachings. The described embodiments are to be considered in all respects only as illustrative and not restrictive and the scope of invention is, therefore, indicated by the appended claims rather than by the foregoing description. Consequently, while the invention has been described with reference to particular embodiments, modifications of structure, sequence, materials and the like would be apparent to those skilled in the art, yet still fall within the scope of the invention.

What is claimed is:

1. A wrist support assembly comprising:

a base having a first end and a second end;

a pivot post located near and movable about the first end of the base;

a tray having a tray base having a first surface and a second surface;

an elongated slot for receiving the pivot post, wherein the pivot post is movable within the elongated slot; and a retainer disposed on the perimeter of the tray for positioning a hand held object.

2. The wrist support assembly of claim 1, wherein the retainer comprises a concave curve formed on the perimeter of the tray adjacent to the second end.

3. The wrist support assembly of claim 1, wherein the retainer comprises a concave curve formed on the perimeter of the tray adjacent to the second end.

4. A wrist support assembly, comprising:

a base having a first end and a second end;

a pivot post mounted on the base near the first end;

a tray having a tray base with a first surface and a second surface and a pivot pin mounted on the first surface of the tray base;

a slide adjacent to the first surface of the tray base, the slide having an elongated slot for receiving the pivot post and an aperture for receiving the pivot pin;

at least one gliding member located on the second surface of the tray base; and an opening in the tray base receiving the pivot post.

5. The wrist support assembly of claim 4, wherein the at least one gliding member comprises at least one ball bearing rotatably mounted on the second surface of the tray base.

6. The wrist support assembly of claim 4, wherein the at least one gliding member comprises at least one piece of low friction material mounted on the second surface of the tray base.

7. The wrist support assembly of claim 4, further comprising a retainer disposed on the perimeter of the tray for positioning a hand held object.

8. The wrist support assembly of claim 7, wherein the retainer comprises a concave curve formed on the perimeter of the tray adjacent to the second end of the base.

9. A wrist support assembly, comprising:

a base having a first end and a second end;

a pivot post mounted on the base near the first end;

a tray having a pivot pin;

a tray base with a first surface and a second surface;

a first side near the first end of the base;

a second side near the second end of the base; and at least one gliding member located on the second surface of the tray base;

a slide having an elongated slot for receiving the pivot post and an aperture for receiving the pivot pin;

a pad disposed on the first surface of the tray base, the pad having an upper surface opposite the tray for supporting a wrist;

a work surface located between the first and the second end of the base; and a retainer comprising a concave curve formed on the second side of the tray for positioning a handheld object.

10. A wrist support assembly comprising:

a base having a first end and a second end;

a pivot post mounted on the base near the first end;

a tray having a tray base with a first surface and a second surface, and a pivot pin mounted on the first surface of the tray base;

a slide adjacent to the first surface of the tray base, the slide having an elongated slot for receiving the pivot post and an aperture for receiving the pivot pin;

an opening in the tray base receiving the pivot post; and at least one gliding member comprising at least one ball bearing rotatably mounted on the second surface of the tray base.

11. The wrist support assembly of claim 10, wherein the at least one gliding member further comprises at least one piece of low friction material mounted on the second surface of the tray base.

* * * * *